US005248413A

United States Patent [19]

Stencel et al.

[11] Patent Number: 5,248,413

[45] Date of Patent: Sep. 28, 1993

[54] PROCESS FOR REMOVING SULFUR AND PRODUCING ENHANCED QUALITY AND ENVIRONMENTALLY ACCEPTABLE PRODUCTS FOR ENERGY PRODUCTION FROM COAL

[75] Inventors: John M. Stencel; Francis J. Derbyshire, both of Lexington, Ky.

[73] Assignee: University of Kentucky Research Foundation, Lexington, Ky.

[21] Appl. No.: 843,407

[22] Filed: Feb. 28, 1992

[51] Int. Cl.[5] ..... C10G 1/00; C10G 1/06; C10B 57/08

[52] U.S. Cl. ..... 208/400; 208/428; 208/435; 208/403; 201/8; 201/9; 44/622; 44/624

[58] Field of Search ..... 208/400, 403, 428, 435; 201/8, 9; 44/622, 624

[56] References Cited

U.S. PATENT DOCUMENTS

| | | | |
|---|---|---|---|
| 3,812,017 | 5/1974 | Santangelo et al. | 201/17 |
| 4,260,471 | 4/1981 | Miller | 208/435 |
| 4,268,417 | 5/1981 | Messer | 257/421 |
| 4,921,831 | 5/1990 | Nakai et al. | 502/418 |
| 4,966,687 | 10/1990 | Trigg | 209/164 |
| 5,116,487 | 5/1992 | Parekh et al. | 209/166 |

*Primary Examiner*—Theodore Morris
*Assistant Examiner*—P. L. Hailey
*Attorney, Agent, or Firm*—King and Schickli

[57] ABSTRACT

A process for producing enhanced quality adsorbent carbons and environmentally acceptable materials for energy production from coal includes an initial step of physically cleaning the coal to remove organic sulfur and mineral tailings. Next, a coal slurry of feedstock and water is prepared. Phosphoric acid is then mixed into the water of the coal slurry to provide by volume 15-85% and more preferably 50-85% phosphoric acid. The slurry is then heated and held in a temperature range between 85° and 230° C. for a period of at least five minutes to allow the phosphoric acid to penetrate deeply into the coal. Then the coal slurry is carbonized at a temperature of between 200°-700° C. for at least five to sixty minutes. The processing produces unique products including a low ash content, low sulfur content carbon solid, a tar with a sulfur content of less than 0.05% of the original feedstock and a gas product having a hydrogen to methane ratio of at least 4:1.

18 Claims, 1 Drawing Sheet

PROCESS FOR REMOVING SULFUR AND PRODUCING ENHANCED QUALITY AND ENVIRONMENTALLY ACCEPTABLE PRODUCTS FOR ENERGY PRODUCTION FROM COAL

TECHNICAL FIELD

The present invention relates generally to the field of coal processing and, more particularly to an improved processing method for removing sulfur from fossil fuels such as coal while simultaneously producing a series of safe and useable products and minimizing the production of sulfur waste products.

BACKGROUND OF THE INVENTION

For approximately 200 years coal has been an important natural resource utilized for various purposes including heating, smelting, coking and the production of electrical energy.

Coal is formed primarily of vegetable matter or plant material that is decomposed under the influence of pressure, temperature and moisture, without access to air. This process results in a change in both the physical and chemical properties of the plant material. It is generally agreed that peat represents the initial, unconsolidated stage in the development of coal. Development continues with time and the application of temperature and pressure to lignite, sub-bituminous, bituminous and anthracite.

The chemical properties of coal are based upon its chemical constituents. The constituents are largely determined by several factors including the type of vegetation from which the coal was originally formed, the extent to which decay was permitted to proceed, the pressure to which the decaying vegetation was subjected, the foreign matter that was deposited onto the decaying vegetation while the vegetation was being converted into coal and the foreign matter that infiltrated in solution after the coal was formed. Additionally, the heat to which the decaying vegetation was subjected is of importance.

The major constituents of coal are carbon, hydrogen, nitrogen, sulfur and oxygen. The proportion of any of these varies from coal seam to coal seam and, to a lesser extent, in the same coal seam.

The amount of carbon in coal increases with rank from lignite at the low end to anthracite at the high end. It is the carbon content of the coal that supplies most of its heating value. The hydrogen content of coal generally ranges between 4.5 and 5.5 percent. This hydrogen also supplies some of the heating value. Oxygen exists in coal in several forms. The oxygen content is useful in coking and in gasificttion and liquefaction of coal. Upon combustion, the carbon, hydrogen and oxygen constituents of the coal combine to produce water vapor, carbon dioxide and some traces of carbon monoxide.

Nitrogen is present in coal almost exclusively in organic combination in percentages up to about three percent. In combustion, the coal nitrogen is converted primarily to elemental nitrogen, ammonia and small amounts of nitrogen oxides.

Of far greater environmental concern is the presence of sulfur in coal and the combustion products produced as a result of that sulfur. More particularly, it is believed that the sulfur byproducts from coal combustion, and sulfur dioxide ($SO_2$) in particular, are responsible for acidifying rainfall to a pH in the range of 3.5 to 4.5. This acid rain damages vehicles, buildings and other personal property. It also collects in lakes and streams lowering the pH level of those bodies of water and, in some cases, adversely affecting those ecosystems.

As a result of these environmental concerns, the federal government has issued regulations within the New Source Performance Standards, NSPS, that limit sulfur dioxide emissions from power production facilities. As a substantial portion of the coal reserves in the United States, and particularly the primary coal reserves located in Kentucky, Illinois, Indiana, Ohio and West Virginia, have relatively high sulfur levels, combustion of these coals will exceed the proposed NSPS standards of sulfur dioxide emissions of less than 1.2 lbs/MMBtu. Accordingly, a need exists for effectively and inexpensively controlling sulfur dioxide emissions in order to allow the continued utilization of this relatively high sulfur eastern coal. This goal may be accomplished by one of two approaches. The first is pre-combustion cleaning of the coal. The second is post-combustion cleanup of the combustion flue gas.

In post-combustion clean up or flue gas scrubbing a water-lime or other water-alkaline slurry is often used to scrub or remove sulfur dioxide from the flue gas before it is emitted at the stack into the atmosphere. The product of this scrubbing is a sludge with an insignificant commercial value, that has to be de-watered and is land filled. Accordingly, this is an expensive process that merely changes the form of the sulfur dioxide environmental hazard but does not eliminate it. In contrast, the present invention relates to a novel and particularly effective process for the pre-combustion removal of sulfur from coal that produces commercially useful products while essentially eliminating the environmental hazard.

SUMMARY OF THE INVENTION

Accordingly, it is a primary object of the present invention to provide an improved process for clean energy production from fossil fuel feedstock and more particularly, for the removal of sulfur from the feedstock and the production of clean fuel sources.

Another object of the present invention is to provide a relatively simple and energy efficient process for the precombustion cleaning of coal feedstock through the utilization of a chemical pyrolysis process utilizing relatively high concentrations of phosphoric acid.

Yet another object of the present invention is to provide a novel process for the production of enhanced quality adsorbent carbons as well as other environmentally acceptable and useful products. Advantageously, this is accomplished while also minimizing the production of sulfur waste products.

A further object of the invention is to provide a two stage process for clean energy production from coal feedstock wherein the first stage employs physical cleaning for the removal of ash and inorganic sulfur and the second stage employs chemical pyrolysis for the energy efficient removal of organic and residual inorganic sulfur from the feedstock. Advantageously, this processing approach produces a unique product stream including: (1) a low ash, low sulfur content carbon solid having a high surface area and a high heat content meeting the new NSPS sulfur dioxide emissions guidelines; (2) a condensible liquid tar having a low sulfur content allowing more direct and efficient processing into higher fuels; and (3) a gas having a hydrogen to methane ratio greater than 3 to 1. In accordance with yet another aspect of the invention, the production of waste sulfur products is minimized as the sulfur removed from the coal feedstock is bound as hydrogen sulfide ($H_2S$) with only traces of carbon oxysulfide (COS) and carbon disulfide ($CS_2$) waste products being produced. Advantageously, commercial processes are available to produce valuable byproducts, including elemental sulfur, from the hydrogen sulfide gas.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved process is provided for efficiently and effectively producing clean energy from coal feedstock. The novel process includes the preparing of a coal slurry from water and the feedstock. Next is the mixing of phosphoric acid with the water in the coal slurry in order to provide 15–85% and more preferably 50–85% by volume phosphoric acid. Further, the weight ratio of coal feedstock to water/phosphoric acid is preferably approximately 2:3.

Following mixing is the step of heating and holding the coal slurry in the presence of all the added phosphoric acid for at least five minutes at a temperature between 85° and 200° C. In this way the necessary time and conditions are provided to allow sufficient penetration of the phosphoric acid into the coal for good sulfur removal. Following phosphoric acid penetration, the coal slurry is carbonized at a temperature of 200°–700° C. for at least five to sixty minutes or longer under an inert atmosphere such as nitrogen or flue gas. During carbonization a unique product stream with minimum waste byproducts is produced as described in greater detail below.

Where the coal feedstock has a mineral content of greater than about 7%, a physical cleaning step is required prior to mixing the feedstock with the phosphoric acid in order to produce the unique product stream. Advantageously, the physical cleaning step serves to remove inorganic forms of sulfur such as pyrite from the coal. Preferably, the physical cleaning step includes grinding run of mine coal to less than 200 mesh. Next is the forming of a coal slurry with water. Then, column flotation technology is utilized to separate the coal and mineral tailings. More particularly, such technology is disclosed in, for example, the co-pending patent application of Parekh and Groppo Jr., application Ser. No. 560,055, filed Jul. 27, 1990, now U.S. Pat. No. 5,116,487, entitled "Froth Flotation Method and Apparatus for Recovery of Ultra-Fine Constituent" and assigned to the assignee of the present invention. The entire disclosure of this copending application is incorporated herein by reference.

Summarizing the column flotation technique, the coal slurry is pumped into a flotation column. Small amounts of surfactants and frothing agents are added to the column to assist in the coal/mineral separation. In a typical arrangement, air is sparged into the flotation column. The surfactants and frothing agents act to make the coal hydrophobic and to stabilize the air bubbles in the froth. As the air bubbles collect on the hydrophobic coal, coal is lifted toward the top of the column where it passes from the column through an overflow. Advantageously, carbon recovery efficiencies are typically around 90%. The amount of the ash in the coal is typically 50–90% less than that in the feedstock. The amount of inorganic sulfur is also decreased by 10–90% from that of the feedstock. In contrast, the mineral tailings sink and are removed from the column at the bottom through a drain.

As stated above, the present process produces a unique group of environmentally safe and useful products. In particular from a starting material of bituminous coal, such as Illinois #6, a carbon solid is produced having a low ash content of less than 10%, a low sulfur content of less than 10% of the original feedstock, a high surface area of greater than 400 $m^2/g$ and a high heat content of greater than 10,000 Btu/lb. Additionally, a liquid tar is produced having a low sulfur content of less than 0.1% of the original feedstock. In fact, where the process includes the physical cleaning step, the liquid tar has an even lower sulfur content of less than 0.05% of the original feedstock.

Additionally, a gas having unique compositional makeup is also produced. Unlike with prior art coal processing methods wherein the gas is rich in methane, gas produced utilizing the present process has a ratio of hydrogen to methane of greater than 3 to 1 with a ratio as high as 4:1 possible. This hydrogen is a valuable commodity with a ready market. Additionally, 60–80% of the sulfur content of the original feedstock is bound into gas as hydrogen sulfide. Advantageously, commercial processes exist to produce valuable byproducts from hydrogen sulfide including elemental sulfur.

It should also be appreciated that the gases produced in the present method include only traces of carbon oxysulfide and carbon disulfide. In contrast, prior art processing methods produce much higher levels of these waste sulfur forms that must be disposed of in a landfill. Advantageously, the levels of carbon oxysulfide and carbon disulfide produced in the present process are so low that the need to adsorb and dispose of these products in a landfill is eliminated. Accordingly, the present processing method has less of an environmental impact and, therefore, is far more attractive to utilize from an environmental standpoint. Additionally, expenses associated with handling and disposing of these wastes are also eliminated.

It should also be appreciated that the present process is very flexible and may be utilized on various ranks of coal or even in the desulfurization of resins and high sulfur oils. Further, by adjusting the various processing parameters, the makeup of the product stream may be significantly altered to provide a more desirable ratio of products and/or products with a more desirable compositional makeup. For example, by bleeding some air into the inert atmosphere during the carbonizing step, it is possible to provide a harder carbon solid product. This harder product is more durable and better withstands the rigors of transport in the bed of a coal truck or in the hopper of a railroad car without crushing and/or pulverizing into powder.

Additionally, the strength of the phosphoric acid may be varied along with the temperature and residence time of the heating and holding step to vary the ultimate penetration of the phosphoric acid into the coal and thereby affect the ultimate products of the process. Further, the carbonizing temperature may be varied and/or the time of the carbonizing step may be adjusted to also affect the product strength, compositional makeup and/or porosity and surface area.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. The drawing is a schematic diagram illustrating the steps of the method of the present invention. Reference will now be made in detail to the present preferred embodiment of the invention, an example of which is illustrated in the accompanying drawing.

DETAILED DESCRIPTION OF THE INVENTION

Figure 1:
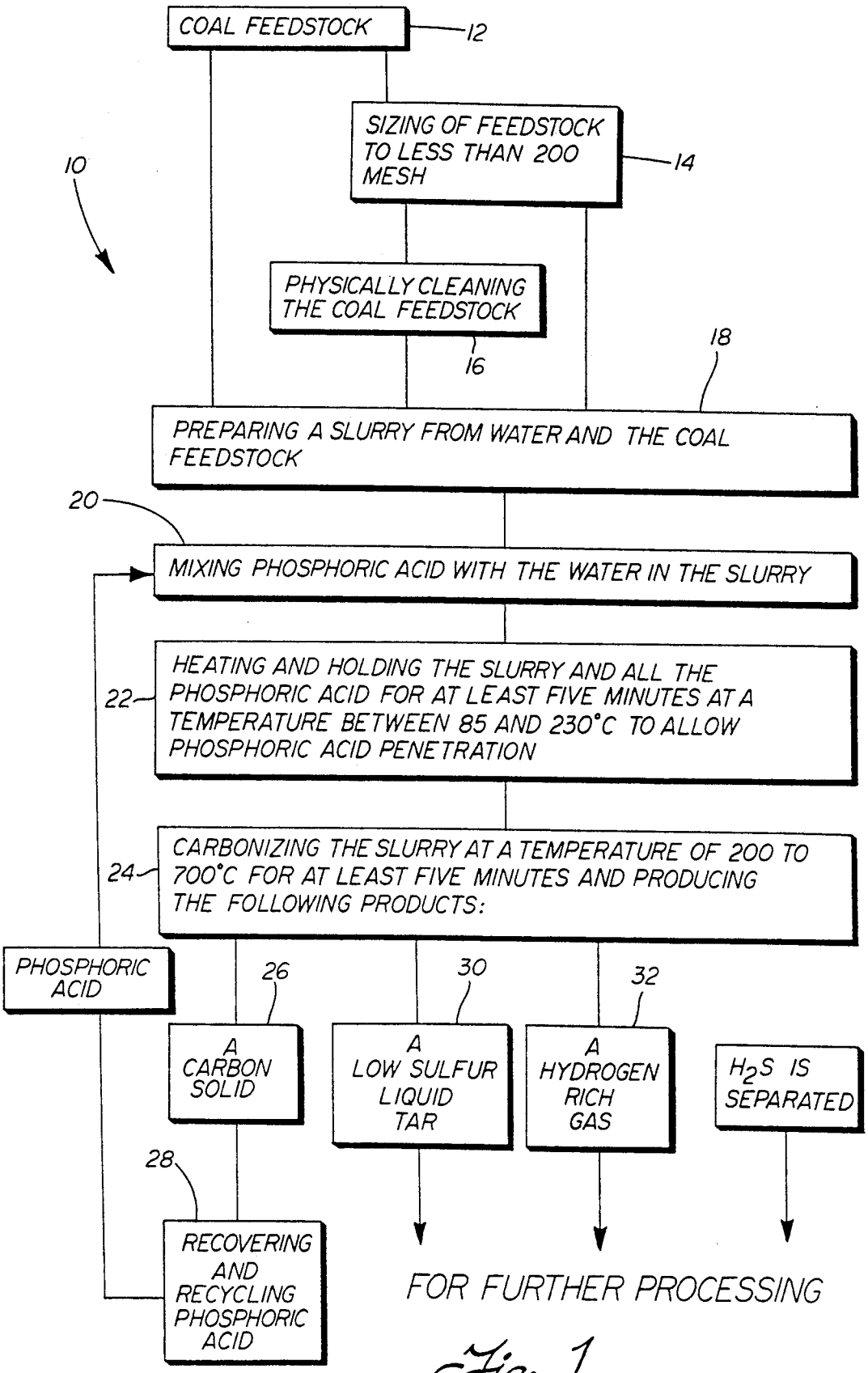

Reference is now made to the drawing figure illustrating the process 10 of the present invention for removing sulfur and producing enhanced quality and environmentally acceptable products from coal by chemical pyrolysis. For purposes of illustration, the coal feedstock 12 is of bituminous rank. It should be appreciated, however, that the present process may be utilized with other rank coals including lignite, subbituminous and anthracite. It could also be utilized with peat and in the desulfurization of other fossil fuels including resins and high-sulfur oils. Accordingly, it should be appreciated that the reference to utilization of the present process with bituminous coal is only presented for purposes of illustration and the invention is not to be considered as limited thereto.

In order to provide effective and efficient removal of sulfur and production of the unique products characteristic of the present invention, it is necessary to first evaluate the coal feedstock 12. If the coal feedstock is of a size of greater than one half inch sizing is required. More particularly, the coal feedstock may be ground in a manner known in the art until a size of less than −200 mesh is realized. Additionally, if the coal feedstock includes significant levels of inorganic sulfur and has an overall mineral content of greater than 7%, it is preferable to complete a physical cleaning of the coal as shown in step 16.

In order to complete the cleaning, column flotation technology such as known in the art may be utilized. An example of one appropriate column flotation technique is disclosed in the above-referenced copending application to Parekh and Groppo, Jr. Initially, a coal slurry is formed with the coal feedstock and water. This slurry is then pumped into a flotation column having a drain for withdrawing mineral tailings and underflow and an overflow for recovering the coal. A mechanism is provided for delivering a wash water medium to an upper portion of the column as well as for delivering diffuse air to a lower portion of the column.

The slurry including the coal feedstock is received and conditioned within a tank that is connected by means of a feedline to the column. A mechanism is provided for dissolving air in the slurry in the conditioning tank. The slurry with the dissolved air is then fed through the feedline into an intermediate portion of the flotation column. Surfactants and frothing agents are added to the slurry as it passes through the feedline. These reagents including, for example, fuel oil No. 2 and methylisobutylcarbinol make the coal hydrophobic. As the mixture of slurry and reagents enters the flotation column it is met by a downwardly flowing stream of wash medium and a upwardly moving stream of diffuse air.

The air bubbles collect on the hydrophobic coal thereby lifting the coal to the overflow of the column where it is recovered. In contrast, the mineral tailings move downwardly with the wash medium for eventual recovery through the drain. Advantageously, the physical cleaning procedure described serves to remove a significant percentage of the mineral tailings. More particularly, from 50–90% of the ash and from 10–90% of the inorganic sulfur in the coal feedstock, depending upon the nature of these impurities in the coal, may be removed utilizing this process. Further, approximately 90% of the coal is recovered through the overflow.

As should be appreciated from the above description, the sizing and physical cleaning steps 14, 16 respectively are optional and are performed depending upon the physical characteristics of the feedstock being processed.

Where the coal feedstock has undergone physical cleaning utilizing the column flotation technique in the manner described, the recovered overflow consists of a slurry that may be utilized in the mixing step. If necessary, additional water may be added. Alternatively, where the coal feedstock includes less than 7% mineral content and the optional physical cleaning step is not conducted, it is necessary to perform the step 18 of preparing a slurry from water and the coal feedstock. Next is the step 20 of mixing phosphoric acid ($H_3PO_4$) with the water in the slurry. Preferably, the mixture is from 15–85% and more preferably from 50–85% by volume phosphoric acid. Further, the weight ratio of coal feedstock to water/phosphoric acid is preferably approximately 2:3. By following these guidelines the necessary strength and quantity of phosphoric acid is provided to efficiently and effectively remove organic sulfur and residual inorganic sulfur from the coal feedstock. The mixing may take place in any type of mixing vessel known in the art and adapted for handling large quantities of aggregate material. Preferably, the mixing vessel is made from or lined with a material, such as stainless steel, that resists corrosion from the phosphoric acid.

Following mixing is the step 22 of heating and holding the slurry and all the phosphoric acid for at least five minutes at a temperature between 85°–230° C. During this time and under these steeping conditions, the phosphoric acid penetrates the coal feedstock so as to allow more effective and complete sulfur removal. It should be recognized that as the feedstock is ground to −200 mesh or less, complete penetration is achieved.

Following phosphoric acid penetration, the step 24 of carbonizing the coal feedstock in the slurry, including the entire amount of added phosphoric acid is completed at a temperature of 200°–700° C. This is a lower temperature than required to complete true thermal pyrolysis. Accordingly, the present method reduces energy consumption and saves resources over thermal pyrolysis methods known to the applicants.

The carbonizing step 24 is conducted for a period of at least five to sixty minutes. This carbonizing step may be completed in a reaction vessel of a type known in the art allowing heating to this temperature and in the presence of an inert atmosphere such as nitrogen or flue gas. It should be appreciated that by adjusting the time of the carbonizing step and/or the temperature, the relative ratio and physical characteristics and properties of the resulting products may be varied in a desired manner. Further, it should be appreciated that some operating parameters provide better results with certain feedstocks. This is true as, is indicated above, the chemical constituents of the coal vary greatly from coal seam to coal seam and to a lesser extent in the same coal seam. Accordingly, an analysis of the starting materials may need to be made to determine inorganic, pyritic and organic concentrations of sulfur within the coal. This information may then be utilized to determine the best parameters for the carbonizing step 24.

It may also be desirable to bleed air into the reaction vessel during the early stages of the carbonizing step. More particularly, small quantities of air tend to produce a harder and more crush resistant solid carbon product that better withstands handling while maintaining its original size. As a result of the above described processing, a series of enhanced quality and environmentally acceptable products are produced from the original coal feedstock 12. More particularly, these products include a carbon solid 26, a liquid tar 30 that is considerable at 0° C. and a hydrogen rich gas 32.

By following the steps of the present process, the carbon solid product 26 has many unique properties. More particularly, the solid product 26 has a low ash content of less than 10% and a low sulfur content of less than 10% of the original feedstock. Additionally, the carbon solid product 26 includes a high surface area that allows its utilization as activated carbon. In fact, the surface area is typically greater than 400 $m^2/g$. Further, the carbon solid product 26 also includes a high heat content of greater than 10,000 Btu/lb. Advantageously, this carbon solid product 26 of high heat content may be burned without further processing by power production facilities and still meet the New Source Performance Standards that limit sulfur dioxide emissions to less than 1.2 lbs/MMBtu. As a result, the present invention allows the utilization of relatively high sulfur eastern coals even under the new and stricter standards thereby maintaining these reserves as valuable and usable resources. As a further result, the jobs and the economies of these eastern coal mining areas are protected.

Prior to utilizing the carbon solid product 26 as an activated carbon or a combustion source for power generation it is desirable for economic reasons to complete the step 28 of recovering and recycling the residual phosphoric acid held in the carbon solid product. To achieve this end the carbon solid product 26 may be leached with water and the water and phosphoric acid recycled for utilization in the mixing step 20. The carbon solid product 26 may then be dried for subsequent use.

The liquid tar product 30 of the present invention is collected by passing the gases evolved during carbonization through a vessel or reservoir that is cooled to near 0° C. This low temperature causes the liquid tar to condense and collect in the vessel. The liquid tar product 30 is particularly unique. The liquid tar product has a low sulfur content of less than 0.1% of the original feedstock. Additionally, where physical cleaning of the coal feedstock 12 has been performed the sulfur content drops to less than 0.05% of the original feedstock. Advantageously, this liquid tar 30 may be used as a feedstock for facile upgrading to valuable distillates. In fact, it may be processed directly into such useful materials as diesel fuel without undergoing expensive desulfurization processing. Accordingly, the liquid tar product 30 of the present invention may be used in the domestic production of valuable hydrocarbon fuels from indigenous resources.

In contrast, it should be appreciated that the processing of similar coals by known prior art methods produces a tar product having from 1.5–6% of the sulfur content of the original feedstock. These sulfur levels are sufficiently high (30 to 120 times higher) to prevent direct processing to diesel fuel: that is, the expensive desulfurization processing is required to effectively utilize the liquid tar product produced in the prior art pyrolysis methods known to the applicants.

An alternative to the utilization of the liquid tar product 30 in the production of hydrocarbon fuels is the utilization of the product as a binder for coal or char reconstitution. More particularly, the sulfur content of the formed solid fuels could be adjusted to enhance their volatile content, thereby adjusting coal reactivity to combustion environments. Additionally, the liquid tar product could be utilized to decrease the porosity of the char, thereby restricting adsorption and exothermic reactions.

The gas 32 produced by the present process 10 is also particularly unique. Specifically, the gas is hydrogen rich wherein the ratio of hydrogen to methane is greater than 3:1. In fact a 4:1 hydrogen to methane ratio is possible. Advantageously, hydrogen is a valuable and useful gas with many industrial uses that may be relatively easily recovered from the gas stream. Accordingly, the relatively high levels of hydrogen gas in the product 32 make the present process 10 very attractive from an economic standpoint. In contrast, the gas product produced by other pyrolysis methods known to the applicants include higher levels of methane than hydrogen.

The gas product 32 includes in addition to hydrogen and methane, carbon monoxide, carbon dioxide, ethane, ethylene and hydrogen sulfide. In fact, up to 80% of the sulfur in the original feedstock is converted to hydrogen sulfide in the gas product. Advantageously, known and relatively inexpensive processing methods may be utilized to obtain elemental sulfur from this hydrogen sulfide. Elemental sulfur is a commercially valuable product for which a market exists. Accordingly, the sale of this sulfur further enhances the economic attractiveness of the present process.

Additionally, it should be appreciated that only trace amounts of carbon disulfide and carbon oxysulfide are produced in the present process 10. In contrast, much higher levels of these byproducts are produced in all other prior art pyrolysis methods known to the applicants. As both carbon disulfide and carbon oxysulfide are more difficult to convert to useful forms, these represent waste sulfur forms that require expensive disposal as, for example, by adsorption on a substrate and burial in a landfill. As carbon disulfide and carbon oxysulfide are present, if at all, in only trace amounts in the products of the present process 10, the additional expense relating to disposal of these materials and the environmental hazard are both effectively avoided. Accordingly, it should be appreciated that the present process 10 is far more attractive, both economically and environmentally, than other previously known pyrolysis processing methods.

The following examples are presented to further illustrate the invention, but are not to be considered as limited thereto. In the examples, proximate analysis of the coals (moisture content, volatile content, "fixed" carbon content and ash content) was carried out in a DuPont TGA 2950 Thermogravimetric Analyzer. The "fixed" carbon content was determined by difference. Ultimate analysis of the coals (carbon, hydrogen and nitrogen content) was carried out in a Leco CHN-600 Elemental Analyzer. The sulfur analysis was performed in a Leco SC-132 Sulfur Analyzer. A Carle Series 400 gas chromatography analyzer was used to determine the concentration of hydrogen sulfide gas liberated during carbonization.

Surface area measurements were obtained from nitrogen adsorption isotherms at 77° K. using an automated adsorption apparatus, Quantachrome Autosorb 6. Macro- and meso-pore volumes and macro- and meso-pore surface areas of the activated carbon solids were determined by mercury porosimetry, using a Quantachrome Autoscan-60 Porosimeter. Specific surface areas, $S_{BET}$, were obtained from the adsorption isotherms using the Brunauer, Emmett and Teller (BET) theory. Non-microporous surface areas, $S'_{BET}$, and micropore volumes were obtained using the $\alpha_s$ method; (Gregg, S. J. Sing, K. S. W., "Adsorption, Surface Area and Porosity", Academic Press, London, 1982); standard isotherm data were taken from Rodriguez-Reinoso F., Martin-Martinez J. M. Predo-Burguete C., McEnaney B., "A Standard Adsorption Isotherm for the Characterization of Activated Carbons", Journal of Physical Chemistry, 91, 515 (1987). The macro- and meso-pore volumes of the activated carbons may be obtained from mercury porosimetry measurements; this method was also used to estimate meso-pore and macro-pore surface areas.

The iodine number was determined as a measure of the capacity of the activated carbon solids for adsorption of small molecules from solution. The iodine number is defined as the number of milligrams of iodine adsorbed by one gram of carbon when the iodine concentration of the residual filtrate is 0.02 normal. The iodine number is useful for comparing the properties of the activated carbon solid product with existing commercial activated carbons. The standard procedure for determining the iodine number is given in "Activated Carbon Evaluation and Selection", Atochem, Inc., CECA Division, 4150 South 100th East Avenue, Suite 300, Tulsa, Okla. 74146. A ground and dried sample of the activated carbon solid product was mixed with a standardized solution of iodine. The mixture was then titrated with standardized thiosulfate solution (and starch solution near the end point), and the amount of iodine adsorbed was calculated.

EXAMPLE 1

Three 20 gram samples of −20 mesh coal feedstock were physically cleaned utilizing the above-described column flotation technique. These samples were then reacted with 30 $cm^3$ of 50% phosphoric acid solution at 170° C. for five minutes in a flowing nitrogen atmosphere (80 ml/min) within a stainless steel reactor. Each sample was then carbonized at 550° C. for sixty minutes in a flowing nitrogen atmosphere (80 ml/min). A horizontal tube furnace was utilized as the heating source.

The sulfur type distribution for the three coal feedstock samples A, B and C is shown below in Table 1.

TABLE 1

Sulfur Type Distribution for Unprocessed Coal Feedstock

| Sample | % Sulfatic S | % Pyritic S | % Organic S |
|---|---|---|---|
| A (Ill. #6) | 1.1 | 28.0 | 70.9 |
| B (Herrin #6) | 1.3 | 58.9 | 39.8 |
| C (Indiana #5) | 0.3 | 49.3 | 50.6 |

Following two-stage processing of physical cleaning and chemical pyrolysis in accordance with the present method of the invention, the sulfur content of the carbon solid products obtained from the samples met the new NSPS standards of 1.2 lbs of sulfur dioxide/MMBtu. The elemental analysis of the solid carbon products obtained from the samples following processing is shown below in Table 2.

TABLE 2

Elemental Analysis of Solid Products Obtained From Coal Feedstock Samples Following Processing

| | Sample - carbon solid product | | |
|---|---|---|---|
| Analysis | A | B | C |
| moisture | 2.2 | 2.2 | 2.82 |
| ash | 7.0 | 8.8 | 9.2 |
| hydrogen | 2.0 | 1.8 | 2.0 |
| nitrogen | 1.0 | 1.1 | 1.8 |
| carbon | 80.8 | 80.5 | 80.0 |
| sulfur | 0.79 | 0.75 | 0.37 |

EXAMPLE 2

Procedure 20.0 gram samples of −20 mesh Illinois #6 were reacted with 30 $cm^3$ of 15%, 50% and 85% phosphoric acid solutions at 170° C. for five minutes in a flowing nitrogen atmosphere (80 ml/min) within a stainless steel reactor. Each sample was then carbonized at a different fixed temperature for sixty minutes in a flowing nitrogen atmosphere (80 ml/min). The temperatures selected were 350° C., 450° C., 550° C. and 650° C. A horizontal tube furnace was utilized as the heating source. One other sample was carbonized at 450° C. in an atmosphere of residual air.

Both the low temperature reaction with phosphoric acid (steeping) at 170° C. and the high temperature carbonization (350°-650° C.) were carried out in the same reactor. During the carbonization step, tar was collected in vessels that were connected to the outlet of the reactor and which were submerged in an ice-water bath. A graduated gas collection vessel was connected to the tar collection vessels. At the start of the experiment the sample being processed was placed in a "cool end" of the reactor not received in the horizontal tube furnace. When the furnace reached the required reaction temperature, the sample was introduced into the end of the reactor extending into the furnace. The sample was withdrawn to the "cool end" at the end of the reaction period. The temperature of the sample was monitored closely during furnace operation.

Results

Comparison of the chemical analysis of the carbon solid products (see Table 3 below), shows that the acid-treatment of Illinois #6 coal causes a rapid increase in carbon content and reduction in H/C and O/C atomic ratio with increasing heat treatment temperature, HTT. The ash contents of the carbon solids generally increase with HTT. Acid-treatment up to HTT=650° C. released about 75% of the sulfur of the coal feedstock mainly as hydrogen sulfide.

TABLE 3

Chemical analysis of Illinois #6 coal feedstock and carbon solid products (wt %)

| Material | HTT °C. | Proximate Moist | Ash | Vol Matt. | Fix-Carb. | C | H | N (daf) | S | P |
|---|---|---|---|---|---|---|---|---|---|---|
| Illinois #6 Coal Feedstock | — | 15.1 | 10.5 | 39.6 | 49.9 | 79.8 | 5.2 | 1.4 | 5.2 | 0.01 |
| Chemically treated carbon solids | 350 | 2.12 | 15.8 | 28.0 | 56.2 | 87.1 | 3.8 | 1.5 | 2.9 | 2.5 |
| | 450 | 2.21 | 26.6 | 25.2 | 48.0 | 86.9 | 2.5 | 1.2 | 1.6 | 5.1 |
| | 550 | 2.32 | 20.8 | 33.9 | 45.3 | 93.4 | 1.4 | 1.4 | 1.2 | 3.9 |
| | 650 | 3.23 | 31.1 | 12.7 | 56.2 | 102.7 | 0.9 | 1.4 | 1.2 | 7.2 |

Surface areas and micro-pore volumes of the carbon solid products are shown in Table 4.

TABLE 4

Influence of process parameters on surface area of activated carbon solid products.

| Sample | Carb. temp (°C.) | Acid conc. (%) | $S_{BET}$ ($m^2/g$) | $S'_{BET}$ α-s plot ($m^2/g$) | $V_{MICRO}$ α-s plot ($cm^3/g$) |
|---|---|---|---|---|---|
| 1. Variable temperature: | | | | | |
| Ill. #6 | 650 | 50 | 539 | 46 | 0.19 |
| Ill. #6 | 550 | 50 | 575 | 56 | 0.20 |
| Ill. #6 | 500 | 50 | 634 | 56 | 0.23 |
| Ill. #6 | 450 | 50 | 401 | 25 | 0.14 |
| Ill. #6 | 350 | 50 | 2 | 1 | 0 |
| 2. Variable acid concentrations: | | | | | |
| Ill. #6 | 550 | 15 | 106 | 19 | 0.03 |
| Ill. #6 | 550 | 50 | 575 | 56 | 0.20 |
| Ill. #6 | 550 | 85 | 719 | 148 | 0.22 |
| 3. Variable gas flow rate: | | | | | |
| Ill. #6 | 450 flow rate = 80 ml/min | | 401 | 25 | 0.14 |
| Ill. #6 | 450 flow rate = 0(**) | | 496 | 32 | 0.18 |

(**)no gas flow, residual air in reactor.

Values of $S'_{BET}$ are about 10% of $S_{BET}$. $S_{BET}$ and $S'_{BET}$ pass through maxima below HTT=650°, however, the effect of HTT on surface area is obscured by the substantial ash contents of the carbon solid products (see Table 3). In addition to the increase in surface areas, the data show that the maxima disappear or are possibly shifted above HTT>650° C. $S'_{BET}$ values for the thermally treated coals increase with HTT up to 24 $m^2/g$ for the Illinois #6 coal series.

Meso- and macro- pore surface areas and volumes were obtained by mercury porosimetry measurements. Comparison of $S'_{BET}$ obtained from nitrogen adsorption with $S_{MESO}$ obtained from mercury porosimetry shows reasonable agreement; the ratio $R=S_{MESO}/S'_{BET}$ is within the range $1<R<2$; similar results have been found in other comparisons of surface areas determined by gas adsorption and mercury porosimetry for a wide range of porous solids (Davis, B. H., "A Comparison of Surface Areas Derived From Mercury Penetration and Nitrogen Adsorption", Applied Catalysis, 10, 185 (1984)). Table 5 shows that macropore surface areas are less than 10% of mesopore surface areas.

TABLE 5

Pore size distribution from mercury porosimetry

| Precursor | HTT (°C.) | Mesopore $S_{MESO}$ ($m^2g^{-1}$) | Mesopore $V_{MESO}$ ($cm^3g^{-1}$) | Macropore $S_{MACRO}$ ($m^2g^{-1}$) | Macropore $V_{MACRO}$ ($cm^3g^{-1}$) |
|---|---|---|---|---|---|
| Illinois #6 | 450 | 58 | 0.14 | 4 | 0.39 |
| Acid treated | 550 | 87 | 0.19 | 5 | 0.51 |
| | 650 | 62 | 0.14 | 5 | 0.53 |

Comparison of micropore volumes obtained from gas adsorption, Table 4, with meso- and macro-pore volumes obtained from mercury porosimetry, Table 5, shows that microspore volumes are slightly greater than mesopore pore volumes, but macropore volumes are much greater. This is not inconsistent with the comparisons of surface areas considered above, since it is expected that the major part of the surface area will reside in the smallest pores. These results therefore lead to the conclusion that, from the adsorption point of view, these carbon solid products are dominantly microporous, but with significant mesoporosity.

The development of surface area with concentration of phosphoric acid activant is shown in Table 4; the micropore surface area is simply ($S_{BET}$-$S'_{BET}$). The total surface area increases strongly from 15 to 50% acid concentration, but increasing the acid concentration to 85% produces a smaller increase in total surface area. The relatively small increase in total BET surface area, following the increase in acid concentration from 50 to 85%, is mainly due to an increase in mesopore surface area; the micropore surface area levels off for acid concentrations above 50%. This suggests that it is possible to "tailor" the pore size distribution of these carbon solid products, to some extent, by varying acid concentration during low temperature treatment of the carbon solid products.

Table 4 also shows surface areas for an activated carbon solid product produced at 450° C. with no gas flow; the sample was carbonized in an atmosphere of residual air. The surface area is 24% higher in the sample carbonized under no gas flow. It is possible that the carbon solid product was partially activated by reaction with residual oxygen in the furnace atmosphere. The results suggest that it should be possible to develop substantially the adsorptive capacity of chemically-activated coal-based carbons by subsequent reaction with oxidizing gases.

Table 6 shows that there is a linear correlation between iodine number and $S_{BET}$, indicating that the capacities of the activated carbon solid products for small molecules adsorbed from the vapor and liquid phases are directly correlated. The repeatability of the iodine number measurements is ±1.5% and, using a commercial activated carbon, the agreement with results obtained by another lab is ±1.5%.

TABLE 6

Measured iodine number and surface area for bituminous coals.

| Sample | Carb Temp | Iodine Number (mg iodine/g carbon) | Surface Area ($m^2/g$) |
|---|---|---|---|
| Ill. #6 | 650 | 449 | 539 |
| Ill. #6 | 550 | 478 | 575 |
| Springfield #5 | 550 | 515 | 660 |
| Herrin #6 | 550 | 124 | 155 |
| Indiana #5 | 550 | 517 | 660 |
| Herrin #6 | 550 | 492 | 657 |

Conclusions

The chemical analysis of carbon solid products of the present process shows that acid-treatment of Illinois #6 coal causes an increase in carbon content and proportional reductions of the H/C and O/C atomic ratios with increased heat treatment temperature, HTT. The ash contents of the carbon solid products also generally increase with HTT. Acid-treatment up to HTT=650° C. releases about 70% to 80% of the sulphur in the original coal mainly as hydrogen disulfide. This compares very favorably with known prior art processes that convert only approximately 30% of the sulfur in the feedstock to hydrogen sulfide.

The adsorptive properties of the carbons produced from Illinois #6 coal are dominated by the presence of micropores. The mesopore surface area contributes only 10% to the total BET surface area, and the macropore surface area is negligible. Treatment of the Illinois #6 coal with 85% phosphoric acid increases the mesopore surface area by acid concentration. Using no forced gas flow through the furnace was found to increase the total surface area of the activated carbon solid product. There is a linear correlation between iodine number and total BET surface area, indicating that the capacities of the activated carbons for small molecules adsorbed from the vapor and liquid phases are directly correlated.

In summary, numerous benefits result from employing the concepts of the present invention. Advantageously, the present process is relatively inexpensive and easy to perform. The process requires relatively short reaction time to produce enhanced quality and environmentally acceptable products for the production of energy from fossil fuels and particularly high sulfur coal. More particularly, the majority of the sulfur, 70–80%, is removed as hydrogen sulfide. Accordingly, it should be appreciated that the present process provides a more complete transfer of sulfur from the feedstock to the gas phase (i.e. hydrogen sulfide) than possible with prior art processing methods. Advantageously, hydrogen sulfide may be processed to recover useful elemental sulfur.

The carbon solid product is a low ash material including low sulfur levels of less than 10% of the sulfur contained in the original feedstock. The carbon solid product also has a relatively high surface area of, for example, greater than 400 $m^2/g$ and a high heat content. Accordingly, the material may be utilized as an activated carbon for use in numerous applications involving, for example, air and water purification or as a fuel for electrical energy production that meets the new NSPS standards.

The novel low sulfur liquid tar product is relatively easy to upgrade to a hydrocarbon fuel such as diesel fuel with minimal additional processing and refining. In fact, further desulfurization processing is essentially not required. Further, it should be appreciated that waste forms of sulfur such as carbon oxysulfide and carbon disulfide are only produced in trace quantities, if at all, utilizing the present process. Accordingly, the expense and environmental concerns relating to the handling of these waste forms is avoided.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

What is claimed is:

1. A process for energy production from coal, comprising the steps of:

preparing a coal slurry from water and said coal;

mixing phosphoric acid with said water in said coal slurry to provide 15 to 85% by volume phosphoric acid;

heating and holding said coal slurry for at least five minutes at a temperature between 85° and 230° C. to allow penetration of said phosphoric acid into said coal;

carbonizing said coal slurry in an inert atmosphere at a temperature of 200°–700° for at least five minutes;

producing products from said processing including; (1) a carbon solid having a low ash content of less than 10% and a low sulfur content of less than 10% of the original coal; (2) a liquid tar having a low sulfur content of less than 0.1% of the original coal; and (3) a gas having a ratio of hydrogen to methane of greater than 3:1 and a sulfur content of 60–80% of the original coal bound as hydrogen sulfide.

2. The process set forth in claim 1, further including physically cleaning said coal prior to mixing with phosphoric acid to remove inorganic sulfur.

3. The process set forth in claim 2, wherein said physical cleaning step includes:

grinding said coal to less than 200 mesh;

forming a coal slurry with water; and conducting column flotation separation so as to separate coal and mineral tailings.

4. The process set forth in claim 1, including varying the temperature of said carbonizing step.

5. The process set forth in claim 1, including bleeding air into said inert atmosphere during said carbonizing step.

6. The process set forth in claim 1, including recovering and recycling water and phosphoric acid.

7. The process set forth in claim 1, wherein said weight ratio of coal to water/phosphoric acid is approximately 2:3.

8. A process for energy production from coal, comprising the steps of:

preparing a coal slurry from water and said coal;

mixing phosphoric acid with water in said coal slurry to provide 50 to 85% by volume phosphoric acid;

heating and holding said coal slurry for at least five minutes at a temperature between 85° and 230° C. to allow penetration of said phosphoric acid into said coal;

carbonizing said coal slurry in an inert atmosphere at a temperature of 200°-700° C. for at least five minutes;

producing products from said processing including; (1) a carbon solid having a low ash content of less than 10% of the original coal; (2) a liquid tar having a low sulfur content of less than 0.1% of the original coal; and (3) a gas having a ratio of hydrogen to methane of greater than 3:1 and a sulfur content of 60-80% of the original coal bound as hydrogen sulfide.

9. The process set forth in claim 8, further including physically cleaning said coal prior to mixing with phosphoric acid to remove inorganic sulfur.

10. The process set forth in claim 9, wherein said physical cleaning step includes:

grinding said coal to less than 200 mesh;

forming a coal slurry with water; and conducting column flotation separation so as to separate coal and mineral tailings.

11. The process set forth in claim 9, wherein said hydrogen to methane ratio of said gas product is 4:1.

12. The process set forth in claim 9, wherein at least 80% of sulfur of said coal is bound as hydrogen sulfide.

13. The process set forth in claim 8, including varying the temperature of said carbonizing step.

14. The process set forth in claim 8, including bleeding air into said inert atmosphere during said carbonizing step.

15. The process set forth in claim 8, including recovering and recycling water and phosphoric acid.

16. The process set forth in claim 8, wherein said weight ratio of coal to water/phosphoric acid is approximately 2:3.

17. A process for energy production from fossil fuel, comprising of the steps of:

preparing a mixture of fossil fuel and water;

mixing phosphoric acid with said water in said mixture of fossil fuel and water so as to provide 15 to 85% by volume phosphoric acid;

heating and holding said fossil fuel, water and phosphoric acid mixture for at least five minutes at a temperature between 85° and 230° C.; and carbonizing said fossil fuel, water and phosphoric acid mixture in an inert atmosphere at a temperature of 200°-700° C. for at least five minutes.

18. The process set forth in claim 17, including bleeding air into said inert atmosphere during said carbonizing step.

* * * * *